US011440088B2

(12) United States Patent
Liu et al.

(10) Patent No.: US 11,440,088 B2
(45) Date of Patent: Sep. 13, 2022

(54) DIE CASTING MACHINE AND DIE CASTING METHOD

(71) Applicant: SHENZHEN LEADWELL TECHNOLOGY CO., LTD., Shenzhen (CN)

(72) Inventors: Siong Song Liu, Shenzhen (CN); Lingling Pan, Shenzhen (CN); Caisheng Liu, Shenzhen (CN); Defei Cheng, Shenzhen (CN); Zhuoming Liu, Shenzhen (CN)

(73) Assignee: SHENZHEN LEADWELL TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 17/321,035

(22) Filed: May 14, 2021

(65) Prior Publication Data

US 2022/0118509 A1 Apr. 21, 2022

(30) Foreign Application Priority Data

Oct. 20, 2020 (CN) ..... 202011127347.4

(51) Int. Cl.
*B22D 17/20* (2006.01)
*B22D 17/08* (2006.01)

(52) U.S. Cl.
CPC ..... *B22D 17/2053* (2013.01); *B22D 17/08* (2013.01)

(58) Field of Classification Search
CPC ..... B22D 17/08; B22D 17/2053; B22D 17/20
See application file for complete search history.

(56) References Cited

FOREIGN PATENT DOCUMENTS

| | | |
|---|---|---|
| CA | 876611 | 7/1971 |
| CN | 107442762 | 12/2017 |
| CN | 108103334 | 6/2018 |
| CN | 108637204 | 10/2018 |
| CN | 108672673 | 10/2018 |
| CN | 109909471 | 6/2019 |
| CN | 111421123 | 7/2020 |
| JP | S6434555 | 2/1989 |
| JP | 3077040 U | 5/2001 |
| JP | 2016120518 | 7/2016 |
| WO | 2015155170 | 10/2015 |

OTHER PUBLICATIONS

English machine translation of Liu et al. (CN 108103334 A) (Year: 2018).*

Office Action issued for Japanese Patent Application No. 2021-019399, dated Jan. 11, 2022, 2 pages.

* cited by examiner

*Primary Examiner* — Kevin P Kerns
*Assistant Examiner* — Steven S Ha
(74) *Attorney, Agent, or Firm* — Hamre, Schumann, Mueller & Larson, P.C.

(57) ABSTRACT

The present disclosure relates to a die casting machine and a die casting method. The die casting machine used in cooperation with a mold (or die) having a die cavity configured to receive molten liquid and includes a plurality of injection mechanisms connected to the mold (or die). Each injection mechanism is provided with an injecting channel through which molten liquid is injected into the die cavity. The plurality of injecting channels are in connection with different positions of the die cavity.

6 Claims, 5 Drawing Sheets

DIE CASTING MACHINE AND DIE CASTING METHOD

CROSS-REFERENCE TO RELATED APPLICATION

This application claims to benefit of Chinese Patent Application No. 2020111273474, filed on Oct. 20, 2020, the entire content of which is incorporated herein in its entirety.

TECHNICAL FIELD

The present disclosure relates to a field of die casting technology, in particular, to a die casting machine and a die casting method.

BACKGROUND

Die-casting machines are widely used in automobile manufacturing and communication equipment manufacturing. The die-casting machines mainly include injection mechanisms that are used in cooperation with molds (or dies). The injection mechanism firstly injects molten metal into a die cavity of a mold (or die), and the molten metal is cooled and solidified to form the desired die casting product. Regarding a conventional die casting machine, when forming a die casting piece with a larger length and a smaller thickness, the formed die casting piece will have an incomplete structure, resulting in insufficient strength or even inaccurate formation. When forming a bulky and complex die casting piece, the die casting piece will also have defects such as insufficient structural strength or even inaccurate formation.

SUMMARY

According to various embodiments, a die casting machine and a die casting method are provided.

A die casting machine used in cooperation with a mold (or die) having a die cavity configured to receive molten liquid and includes a plurality of injection mechanisms connected to the mold (or die). Each injection mechanism is provided with an injecting channel through which molten liquid is injected into the die cavity. The plurality of injecting channels are in connection with different positions of the die cavity.

In one of the embodiments, the die cavity is partially defined by a left inner wall of the mold (or die). The plurality of injection mechanisms include a left injection mechanism whose injecting channel extends through the left inner wall.

In one of the embodiments, the die cavity is further partially defined by a right inner wall of the mold (or die). The left inner wall and the right inner wall are spaced apart in a first direction. The plurality of injection mechanisms include a right injection mechanism whose injecting channel extends through the right inner wall.

In one of the embodiments, a central axis of the injecting channel of the left injection mechanism and a central axis of the injecting channel of the right injection mechanism are parallel with the first direction.

In one of the embodiments, a central axis of the injecting channel of the left injection mechanism and a central axis of the injecting channel of the right injection mechanism form an angle with the first direction.

In one of the embodiments, the die cavity is further partially defined by a front inner wall and a rear inner wall of the mold (or die). The front inner wall and the rear inner wall are spaced apart in a second direction perpendicular to the first direction. The front, left, rear, and right inner walls are successively connected. The plurality of the injection mechanisms further include a front injection mechanism whose injecting channel extends through the front inner wall and a rear injection mechanism whose injecting channel extends through the rear inner wall.

In one of the embodiments, a central axis of the injecting channel of the front injection mechanism and a central axis of the injecting channel of the rear injection mechanism are parallel with or inclined with the second direction.

In one of the embodiments, the die cavity is further partially defined by an upper inner wall and a lower inner wall of the mold (or die). The upper inner wall and the lower inner wall are spaced apart in a third direction perpendicular to the first direction and the second direction. The upper inner wall is connected to upper ends of the front, left, rear, and right inner walls. The lower inner wall is connected to lower ends of the front, left, rear, and right inner walls. The plurality of the injection mechanisms further include a upper injection mechanism whose injecting channel extends through the upper inner wall and a lower injection mechanism whose injecting channel extends through the lower inner wall.

In one of the embodiments, a central axis of the injecting channel of the upper injection mechanism and a central axis of the injecting channel of the lower injection mechanism are parallel with or inclined with the third direction.

In one of the embodiments, the mold (or die) is provided with a plurality of casting channels in connection with the die cavity. The injection mechanism further includes an injecting chamber inserted into the casting channel. The injecting channel is provided in the injecting chamber.

A die casting method includes providing a mold (or die) having a die cavity; providing a plurality of injection mechanisms, each injection mechanism being provided with an injecting channel, the plurality of injecting channels being in connection with different positions of the die cavity; injecting molten liquid into the die cavity through the plurality of injecting channels; and cooling the molten liquid in the die cavity.

In one of the embodiments, the molten liquid is injected into the die cavity through the plurality of injecting channels simultaneously.

In one of the embodiments, the molten liquid is injected into the die cavity through the plurality of injecting channels in a chronological order.

Other features, aspects and advantages of the present invention can be seen on review of the figures, the detailed description, and the claims which follow.

BRIEF DESCRIPTION OF THE DRAWINGS

The components in the drawings are not necessarily drawn to scale, the emphasis instead being placed upon clearly illustrating the principles of the present disclosure. Moreover, in the drawings, like reference numerals designate corresponding parts throughout the views.

DETAILED DESCRIPTION OF THE EMBODIMENTS

In order to facilitate the understanding of the present disclosure, the present disclosure will be described more fully with reference to the relevant drawings. Preferred embodiments of the present disclosure are shown in the attached drawings. However, the present disclosure can be implemented in many different forms and is not limited to the embodiments described herein. On the contrary, providing these embodiments is to make the disclosure of the present disclosure more thorough and comprehensive.

It should be noted that when an element is referred to as being "fixed to" another element, it can be directly on another element or there may be an intermediate element therebetween. When an element is considered to be "connected to" another element, it can be directly connected to another element or there may be an intermediate element at the same time. Terms "inner", "outer", "left", "right" and the like used herein are for illustrative purposes only, and do not mean that they are the only embodiments.

Figure 1:
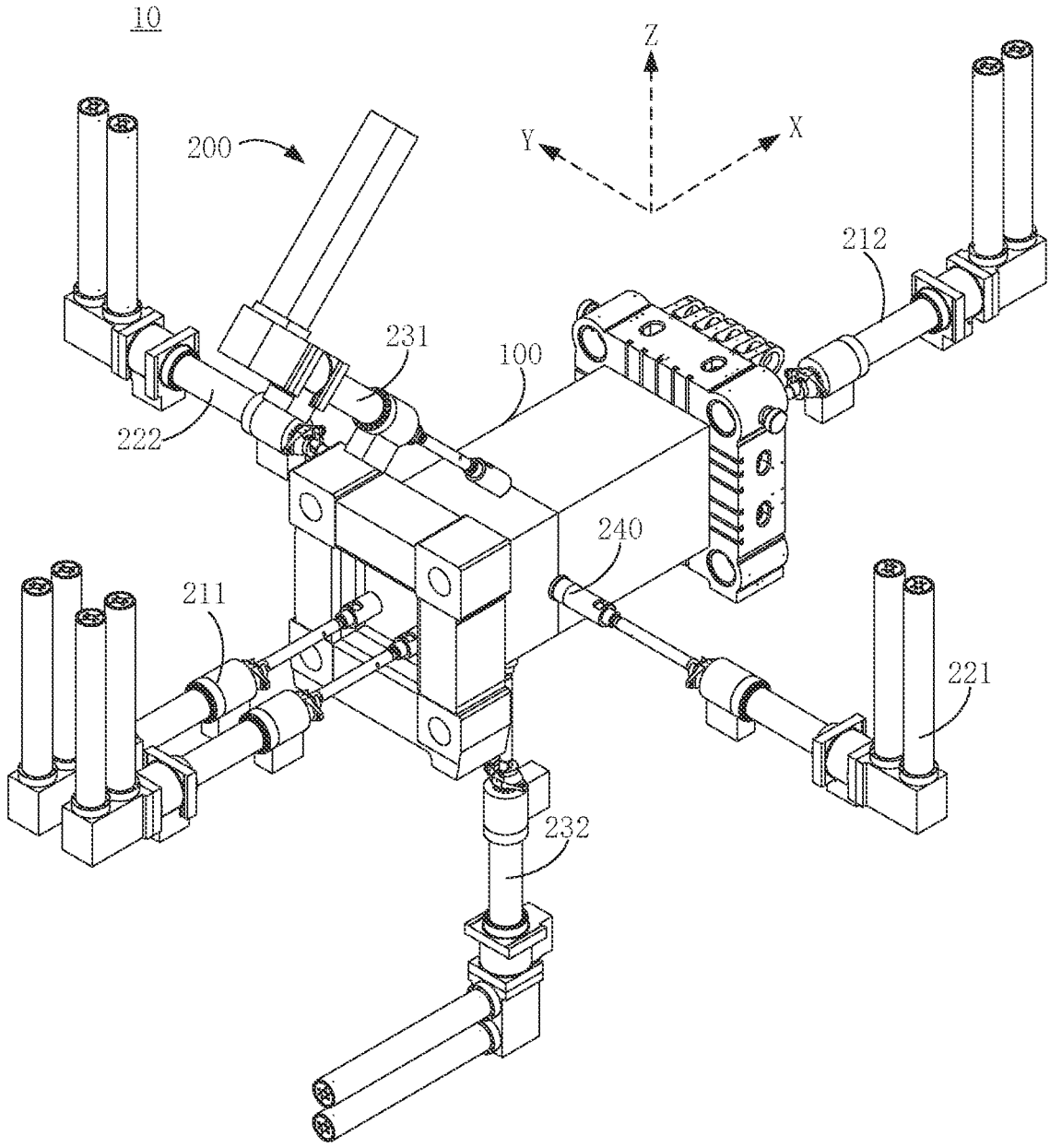
FIG. 1 is a perspective view of a die casting machine according to an embodiment.
Figure 3:
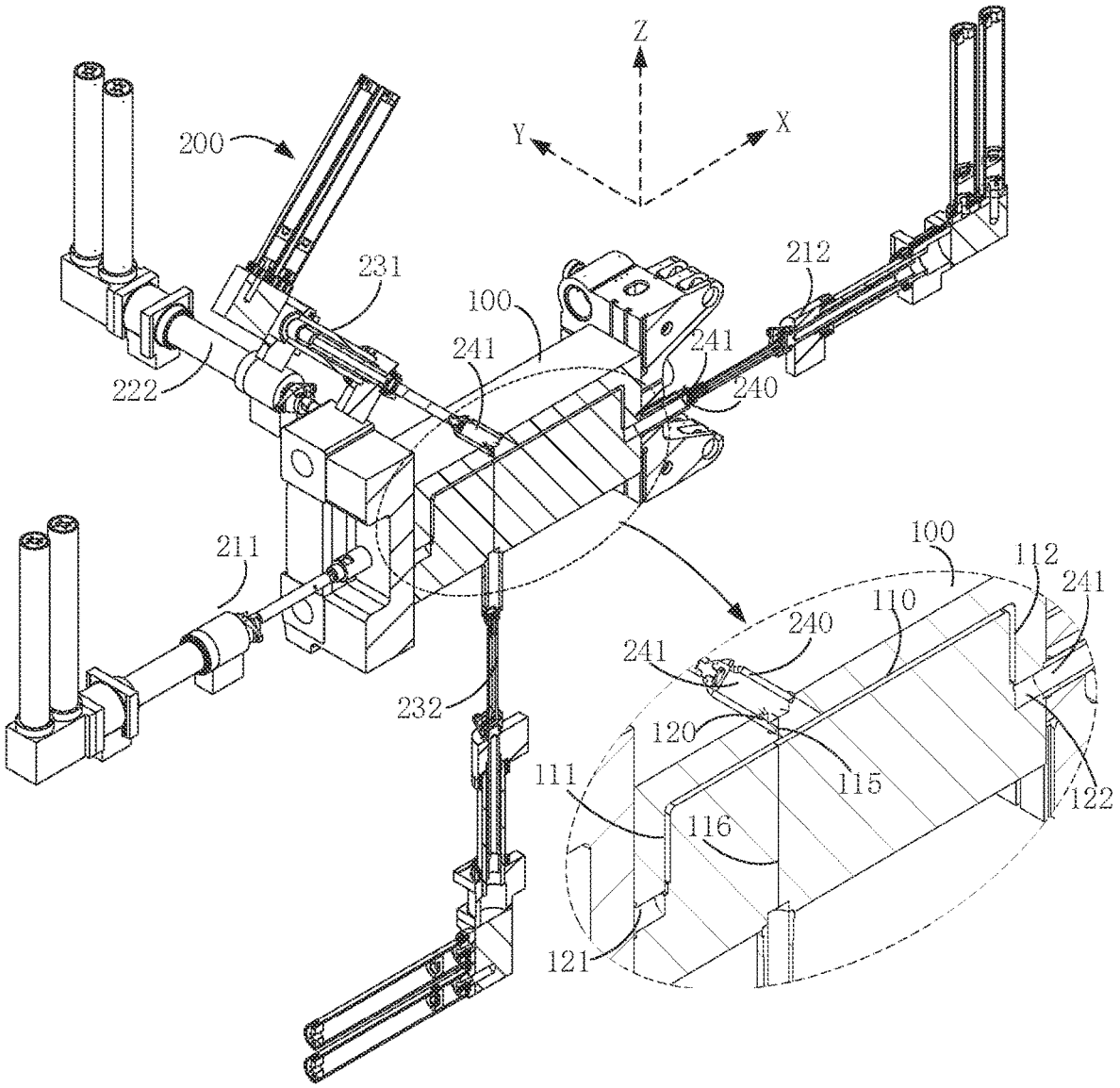
FIG. 3 is a perspective sectional view of the die casting machine shown in FIG. 1 in a traverse direction.
Figure 4:
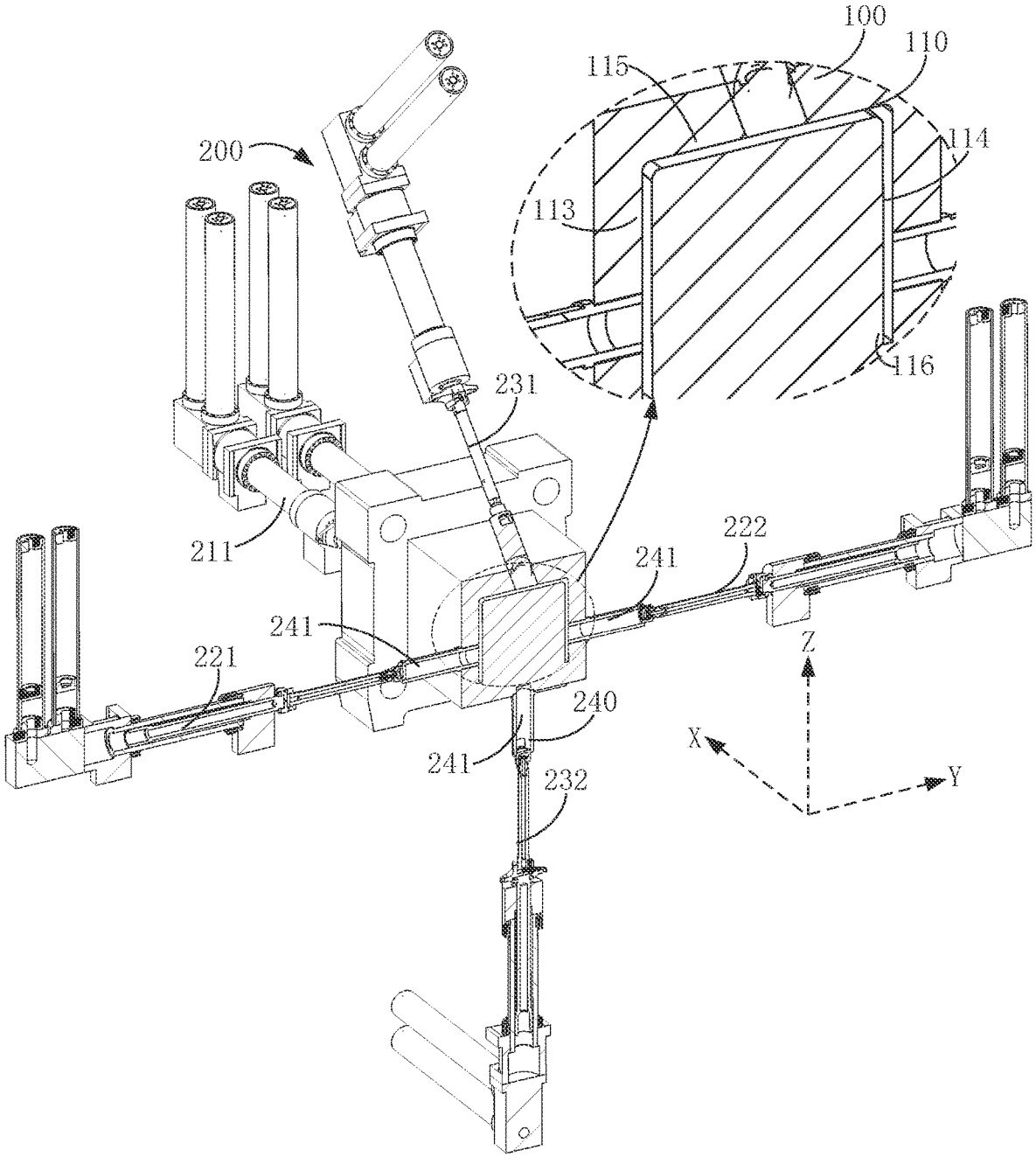
FIG. 4 is a perspective sectional view of the die casting machine shown in FIG. 1 in a longitudinal direction.

Referring to FIGS. 1, 3 and 4, according to an embodiment, a die casting machine 10 is provided, which is used in cooperation with a mold (or die) 100 and includes a plurality of injection mechanisms 200. The mold (or die) 100 is provided with a die cavity 110. The plurality of injection mechanisms 200 are connected to the mold (or die) 100 from various aspects. Each injection mechanism 200 is provided with a power source and an injecting channel 241, through which molten liquid can be injected into the die cavity 110. The molten liquid can be, for example, a molten metal. The plurality of injecting channels 241 of different injection mechanisms 200 are in connection with different (for example, more than one) positions of the die cavity 110. In other embodiments, more than one different positions of the die cavity 110 can also be in connection with injecting channels 241 of the same injection mechanisms 200.

Specifically, the mold (or die) 100 is also provided with a plurality of casting channels 120. The casting channels 120 can be in connection with an outside and the die cavity 110. Different casting channels 120 are in connection with different positions of the die cavity 110. The injection mechanism 200 further includes an injecting chamber 240. The injecting channel 241 is provided in the injecting chamber 240. Each injecting chamber 240 corresponds to the casting channel 120. For example, the injecting chamber 240 can be directly inserted into the casting channel 120. After the molten metal is injected into the injecting channel 241, the power source of the injection mechanism 200 can apply a certain pressure to the molten liquid, such that the molten liquid can be injected into the die cavity 110 through the injecting chamber 240.

If one injection mechanism is used to inject the molten liquid into the die cavity at a specific position of the die cavity, for a die casting piece with a larger length and a smaller thickness, a length of the die cavity is inevitably larger and an internal space thereof is inevitably relatively narrow, such that the flow resistance of the molten liquid in the narrow die cavity is increased, and the pressure loss of the molten liquid flowing in the die cavity is also huge. Therefore, for a proximal portion of the die cavity close to the injection mechanism, the molten liquid in the injection mechanism can fully fill the proximal portion of the die cavity. However, for a distal portion of the die cavity away from the injection mechanism, the molten liquid cannot reach the distal portion in time due to the longer flow path and the larger pressure loss. Moreover, the molten liquid in the proximal portion has begun to solidify, which further constitutes an obstacle for the molten liquid to flow to the distal portion of the die cavity, such that the distal portion of the die cavity cannot be filled with the molten liquid, and finally, the die casting piece cannot be accurately formed as desired due to the incomplete structure, which results in a die casting failure.

If the pressure of the injection mechanism is large enough, the molten liquid may barely fill the entire die cavity. However, according to the principle of thermal expansion and contraction, the molten liquid will shrink in volume during the cooling and solidification process, such that the proximal portion and the distal portion of the die cavity may not be fully filled with the molten liquid after the volume shrinkage, resulting in a new void. Although in that case, the new void at the proximal portion of the die cavity can be refilled to compensate for the shrinkage, the molten liquid has solidified to form viscous or solid metal blocks, which may further narrow the flow space of the molten liquid to the distal portion of the die cavity, such that the flow resistance and pressure loss are increased, resulting in that the molten liquid cannot be injected into the new void at the distal portion of the die cavity to compensate for the shrinkage. Since the new void cannot be injected with the molten liquid to compensate for the shrinkage, a thinner portion of the die casting piece is not very dense, and a large number of shrinkage holes will be formed, which will result in that the formed die casting piece may not have sufficient structural strength to meet the requirements of relevant technical standards. Moreover, the flow path of the molten liquid to the distal portion of the die cavity is long, which increases the total time required for the molten liquid to fill the entire die cavity, and ultimately affects the forming efficiency of the die casting piece.

For a large and complex die casting piece, the total volume of the die cavity is inevitably larger, and the structure of the die cavity is more complicated. When one injection mechanism is still used to inject the molten liquid into the die cavity at a specific position of the die cavity, since the injection channels of the one injection mechanism has a limited volume, it is difficult for the injection mechanism to fill the die cavity with a larger volume in a single casting amount of the molten liquid, which ultimately results in that the die casting piece cannot be accurately formed as desired due to the incomplete structure. That is, the die casting piece failed. Even if the injection mechanism can fill the die cavity with a larger volume in an enough single casting amount of the molten liquid, referring to the above analysis on the formation of the die casting piece with a larger length and a smaller thickness, the molten liquid will also shrink in volume during the cooling and solidification process, such that new voids will be formed in the proximal portion and the distal portion of the die cavity. Due to the fact that the molten liquid has solidified to form the viscous or solid metal blocks, the metal blocks further narrow the flow space of the molten liquid to the distal portion of the die cavity, such that the flow space is narrower, which further increases the flow resistance and pressure loss, resulting in that the molten liquid cannot be injected into the new void at the distal portion of the die cavity to compensate for the "shrinkage". Moreover, the distal portion of the die casting piece is formed with the large number of shrinkage holes due to being not dense. As a result, the formed die casting piece does not have sufficient structural strength. In addition, the flow path of the molten liquid to the distal portion of the die cavity is relatively long, which ultimately affects the forming efficiency of the die casting piece.

Regarding the die casting machine 10 according to the above embodiments, since there are multiple injecting channels being in connection with more than one different positions of the die cavity 110, a distance from different positions of the die cavity 110 to the injecting channel 241 is shortened, such that the different positions of the die cavity 110 all become the proximal portions with respect to the different injecting channels 241. For the die casting piece with the larger length and the smaller thickness, the flow path of the molten liquid can be shortened, thereby reducing the flow resistance and pressure loss of the molten liquid, reducing the total time required for the molten liquid to fill the entire die cavity 110, and improving the forming efficiency of the die casting piece. In addition, since each of the portions of the die cavity 110 can be filled with the molten liquid, the solidified die casting piece is completely and accurately formed. Moreover, when the molten liquid solidifies and shrinks in volume to form new void at an edge portion of the die cavity 110, different positions of the new void are relatively close to the different injecting channels 241, thereby reducing the flow paths of the molten liquid reaching different positions of the new void, eliminating the obstacle to the flow of the molten liquid from the viscous or solid metal blocks, ensuring that the molten liquid in the different injecting channels 241 can fill the different positions of the new void in time to compensate for shrinkage, and prevent shrinkage holes in the die casting piece. Therefore, the density of the die casting piece is increased, and ultimately, the structural strength of the die casting piece is ensured.

For large and complex die casting pieces, due to the multiple injection mechanisms 200, a total of the single casting amount of the molten liquid in each injection mechanism 200 is greater than the volume of die cavity 110, which ensures that the molten liquid fills the entire die cavity 110, thus resulting that the solidified die casting piece has a complete structure and is accurately formed. When the plurality of injection mechanisms 200 inject the molten liquid into the die cavity 110 simultaneously, the total time required for the molten liquid to fill the die cavity 110 can be shortened, thereby improving the forming efficiency of the die casting piece. Similarly, when the molten liquid shrinks in volume such that the new void is formed at the edge of the die cavity 110, the different positions of the new void are relatively close to the different injection channels 241, ensuring that the molten liquid in the different injection channels 241 can fill different positions of the new void in time to compensate for "shrinkage". Finally, the structural strength of the die casting piece is ensured. In addition, the die casting piece with the large and complex structure can be formed in a single time, thus avoiding producing various parts of the product through different equipment and using different tooling to assemble the parts into products. In this way, it is not only improving production efficiency, but also reduce the number of production equipment, labor costs, production costs and floor space of the factory.

Figure 2:
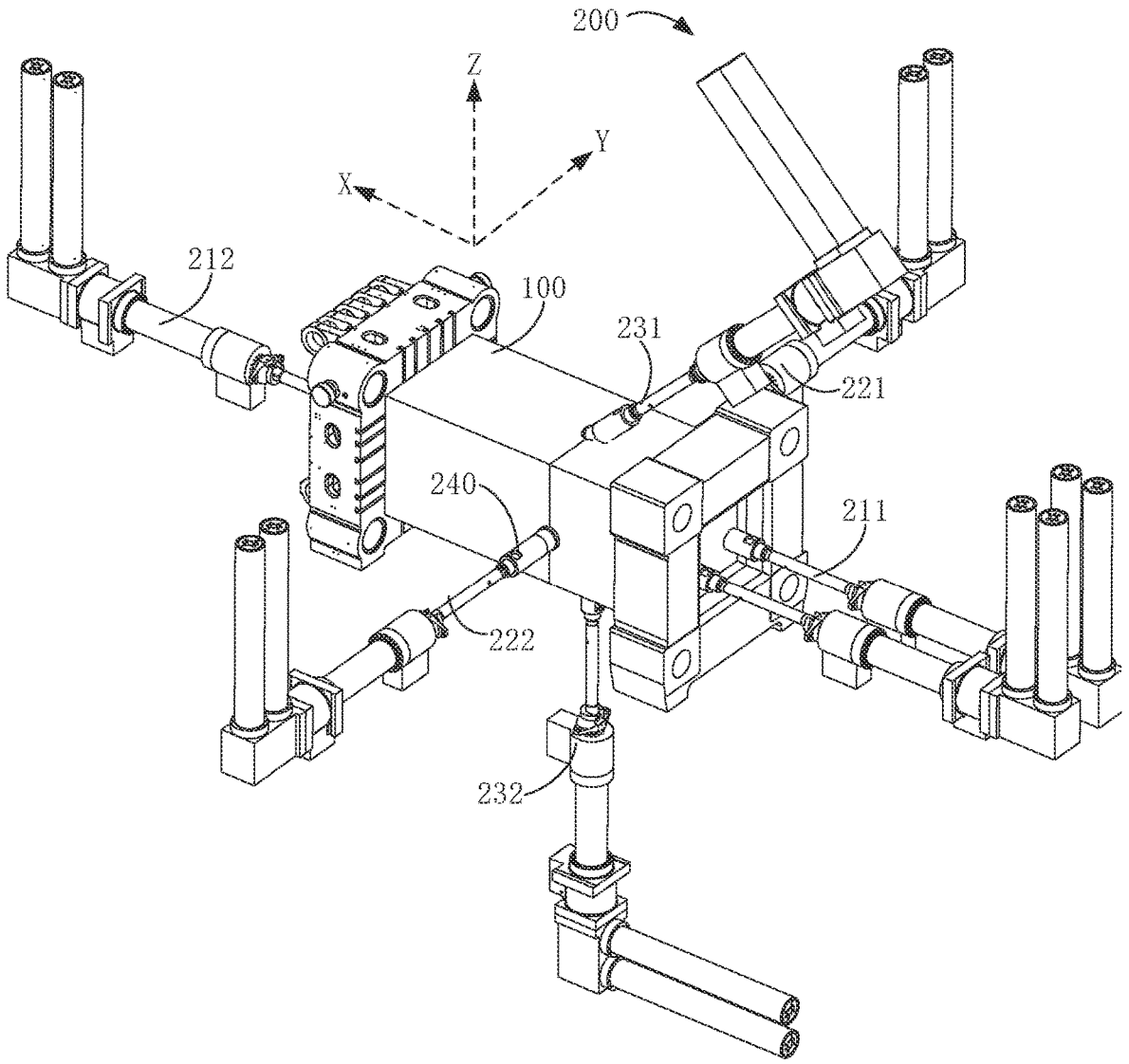
FIG. 2 is similar to FIG. 1, but viewed from another aspect.

Referring to FIGS. 2, 3 and 4, in some embodiments, the die cavity 110 is partially defined by a left inner wall 111 and a right inner wall 112. The left inner wall 111 and the right inner wall 112 may be flat or curved. The left inner wall 111 and the right inner wall 112 are spaced apart in a first direction (e.g., horizontal X-axis direction). The casting channels 120 include a left casting channel 121 and a right casting channel 122. The left casting channel 121 extends through the left inner wall 111 and is in connection with the die cavity 110 and the outside. The right casting channel 122 extends through the right inner wall 112 and is in connection with the die cavity 110 and the outside. The injection mechanism 200 includes a left injection mechanism 211 and a right injection mechanism 212. An injecting chamber 240 of the left injection mechanism 211 is inserted into the left casting channel 121. The number of the left injection mechanism 211 is equal to the number of the left casting channel 121. There is a one-to-one correspondence between the left injection mechanisms 211 and the left casting channels 121. An injecting chamber 240 of the right injection mechanism 212 is inserted into the right casting channel 122. The number of the right injection mechanism 212 is equal to the number of the right casting channel 122. There is a one-to-one correspondence between the right injection mechanism 212 and the right casting channel 122.

Since the left inner wall 111 and the right inner wall 112 are spaced apart in the first direction, a left portion of the die cavity 110 is adjacent to the left injection mechanism 211 in the first direction, such that the left portion of the die cavity 110 is the proximal portion with respect to the left injection mechanism 211. A right portion of the die cavity 110 is adjacent to the right injection mechanism 212, such that the right portion of the die cavity 110 is also the proximal portion with respect to the right injection mechanism 212. Therefore, the die cavity 110 does not have the distal portion in the first direction. In this way, the molten liquid can fill the entire die cavity 110 in the first direction in a short time, such that the die casting piece can be quickly and accurately formed. In addition, when the volume shrinks due to the solidification of the molten liquid, and the new void is formed at the edge portion of the die cavity 110, a left portion of the void is closer to the left injection mechanism 211, and a right portion of the void is closer to the right injection mechanism 212. In this way, the molten liquid of the left injection mechanism 211 can quickly fill the left portion of the void, and the molten liquid of the right injection mechanism 212 can quickly fill the right portion of the void. Finally, different positions of the void can be filled with the molten liquid to compensate for the shrinkage, so as to ensure the structural strength of the die casting piece.

When a plurality of left injection mechanism 211 and a plurality of right injection mechanism 212 are provided, the time required for the die cavity 110 to be filled with the molten liquid can be further reduced, and the time required for the void to be filled with molten liquid can also be reduced, thereby further improving the forming efficiency of the die casting pieces. A central axis of the injecting channel 241 of the left injection mechanism 211 and a central axis of the injecting channel 241 of the right injection mechanism 212 can be parallel with the first direction. In other embodiments, the central axis of the injecting channel 241 of the left injection mechanism 211 and the central axis of the injecting channel 241 of the right injection mechanism 212 may form an angle with the first direction. That is, the central axes of the injecting channels 241 of the left injection mechanism 211 and the right injection mechanism 212 are inclined with the first direction, such that the central axes are intersected with the first direction. Therefore, by changing an injecting direction of the molten liquid, the time required for the die cavity 110 and the new void to be filled with the molten liquid can be reduced to a certain extent.

In some embodiments, the die cavity 110 is further defined by a front inner wall 113 and a rear inner wall 114. The front inner wall 113 and the rear inner wall 114 may be flat or curved. The front inner wall 113 and the rear inner wall 114 are spaced apart in a second direction (e.g., horizontal Y-axis direction) perpendicular to the first direction. The left, right, front and rear inner walls 111, 112, 113 and 114 are successively connected. Specifically, the front inner wall 113 is connected between a front end of the left inner wall 111 and a front end of the right inner wall 112. The rear inner wall 114 is connected between a rear end of the left inner wall 111 and a front end of the right inner wall 112. The casting channel 120 further includes a front casting channel and a rear casting channel. The front casting channel extends through the front inner wall 113 and is in connection with the die cavity 110 and the outside. The rear casting channel extends through the rear inner wall 114 and is in connection with the die cavity 110 and the outside. The injection mechanism 200 further includes a front injection mechanism 221 and a rear injection mechanism 222. An injecting chamber 240 of the front injection mechanism 221 is inserted into the front casting channel. The number of the front injection mechanism 221 is equal to the number of the front casting channel. There is a one-to-one correspondence between the front injection mechanism 211 and the front casting channel. An injecting chamber 240 of the rear injection mechanism 222 is inserted into the rear casting channel. The number of the rear injection mechanism 222 is equal to the number of the rear casting channel. There is a one-to-one correspondence between the rear injection mechanism 222 and the rear casting channel.

Since the front inner wall 113 and the rear inner wall 114 are spaced apart in the second direction, a front portion of the die cavity 110 is adjacent to the front injection mechanism 221 in the second direction, such that the front portion of the die cavity 110 is the proximal portion with respect to the front injection mechanism 221. A rear portion of the die cavity 110 is adjacent to the rear injection mechanism 222 in the second direction, such that the rear portion of the die cavity 110 is also the proximal portion with respect to the rear injection mechanism 222. Therefore, the die cavity 110 does not have the distal portion in the second direction. In this way, the molten liquid can fill the entire die cavity 110 in the second direction in a short time, such that the die casting piece can be quickly and accurately formed. In addition, when the volume shrinks due to the solidification of the molten liquid, and the new void is formed at the edge portion of the die cavity 110, a front portion of the void is closer to the front injection mechanism 221, and a rear portion of the void is closer to the rear injection mechanism 222. In this way, the molten liquid of the front injection mechanism 221 can quickly fill the front portion of the void, and the molten liquid of the rear injection mechanism 222 can quickly fill the rear portion of the void. Finally, different positions of the void can be filled with the molten liquid to compensate for the shrinkage, so as to ensure the structural strength of the die casting pieces.

When a plurality of front injection mechanism 221 and a plurality of rear injection mechanism 222 are provided, the time required for the die cavity 110 to be filled with the molten liquid can be further reduced, and the time required for the void to be filled with molten liquid can also be reduced, thereby further improving the forming efficiency of the die casting pieces. A central axis of the injecting channel 241 of the front injection mechanism 221 and a central axis of the injecting channel 241 of the rear injection mechanism 222 can be parallel with the second direction. In other embodiments, the central axis of the injecting channel 241 of the front injection mechanism 221 and the central axis of the injecting channel 241 of the rear injection mechanism 222 may form an angle with the second direction. That is, the central axes of the injecting channels 241 of the front injection mechanism 221 and the rear injection mechanism 222 are inclined with the second direction, such that the central axes are intersected with the second direction. Therefore, by changing the injecting direction of the molten liquid, the time required for the die cavity 110 and the void to be filled with the molten liquid can be reduced to a certain extent.

In some embodiments, the die cavity 110 is further defined by an upper inner wall 115 and a lower inner wall 116. The upper inner wall 115 and the lower inner wall 116 may be flat or curved. The upper inner wall 115 and the lower inner wall 116 are spaced apart in a third direction (e.g., Z-axis direction). The third direction is perpendicular to the first direction and the second direction. In this case, the first direction, the second direction and the third direction together constitute extending directions of three coordinate axes of a space rectangular coordinate system. As shown in FIGS. 3 and 4, the upper inner wall 115 is connected to upper ends of the left, right, front and rear inner walls 111, 112, 113 and 114, and the lower inner wall 116 is connected to lower ends of the left, right, front and rear inner walls 111, 112, 113 and 114. The casting channel 120 further includes an upper casting channel and a lower casting channel. The upper casting channel extends through the upper inner wall 115 and is in connection with the die cavity 110 and the outside. The lower casting channel extends through the lower inner wall 116 and is in connection with the die cavity 110 and the outside. The injection mechanism 200 further includes an upper injection mechanism 231 and a lower injection mechanism 232. An injecting chamber 240 of the upper injection mechanism 231 is inserted into the upper casting channel. The number of the upper injection mechanism 231 is equal to the number of the upper casting channel. There is a one-to-one correspondence between the upper injection mechanism 231 and the upper casting channel. An injecting chamber 240 of the lower injection mechanism 232 is inserted into the lower casting channel. The number of the lower injection mechanism 232 is equal to the number of the lower casting channel. There is a one-to-one correspondence between the lower injection mechanism 232 and the lower casting channel.

Since the upper inner wall 115 and the lower inner wall 116 are spaced apart in the third direction, an upper portion of the die cavity 110 is adjacent to the upper injection mechanism 231 in the third direction, such that the upper portion of the die cavity 110 is the proximal portion with respect to the upper injection mechanism 231. A lower portion of the die cavity 110 is adjacent to the lower injection mechanism 232, such that the lower portion of the die cavity 110 is also the proximal portion with respect to the lower injection mechanism 232. Therefore, the die cavity 110 does not have the distal portion in the third direction. In this way, the molten liquid can fill the entire die cavity 110 in the third direction in a short time, such that the die casting piece can be quickly and accurately formed. In addition, when the volume shrinks due to the solidification of the molten liquid, and a new void is formed at the edge portion of the die cavity 110, an upper portion of the void is closer to the upper injection mechanism 231, and a lower portion of the void is closer to the lower injection mechanism 232. In this way, the molten liquid of the upper injection mechanism 231 can quickly fill the upper portion of the void, and the molten liquid of the lower injection mechanism 232 can quickly fill the lower portion of the void, such that different positions of the void can be filled with the molten liquid to compensate for the shrinkage, so as to ensure the structural strength of the die casting pieces.

When a plurality of upper injection mechanism 231 and a plurality of lower injection mechanism 232 are provided, the time required for the die cavity 110 to be filled with the molten liquid can be further reduced, and the time required for the void to be filled with molten liquid can also be reduced, thereby further improving the forming efficiency of the die casting pieces. In the illustrated embodiment, a central axis of the injecting channel 241 of the upper injection mechanism 231 form an angle with the third direction, and a central axis of the injecting channel 241 of the lower injection mechanism 232 is parallel with the third direction. In other embodiments, a central axis of the injecting channel 241 of the upper injection mechanism 231 and a central axis of the injecting channel 241 of the lower injection mechanism 232 may be parallel with the third direction. In other embodiments, the central axis of the injecting channel 241 of the upper injection mechanism 231 and/or the central axis of the injecting channel 241 of the lower injection mechanism 232 may form an angle with the third direction. That is, the central axis of the injecting channels 241 of the upper injection mechanism 231 and/or lower injection mechanism 232 are inclined with the third direction, such that the central axis is intersected with the third direction. Therefore, by changing the injecting direction of the molten liquid, the time required for the die cavity 110 and the void to be filled with the molten liquid can be reduced to a certain extent.

Therefore, the injection mechanism 200 can inject the molten liquid into the die cavity 110 from the first direction, the second direction, and the third direction, which can reduce the time required for filling the die cavity 110 and the void with the molten liquid, and ensure that the die casting piece is formed quickly and accurately and has sufficient structural strength.

Figure 5:
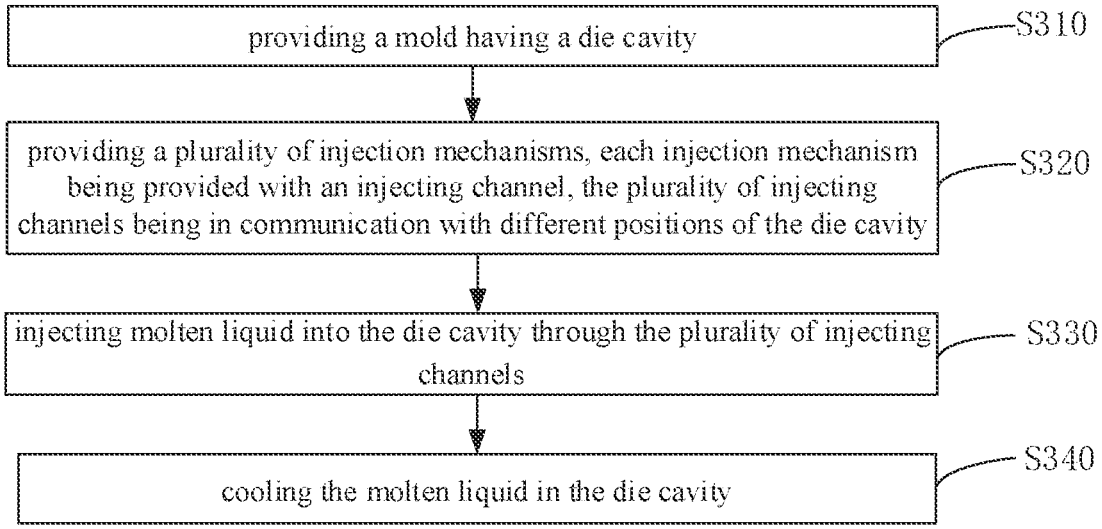
FIG. 5 is a flowchart of a die casting method according to an embodiment.

Referring to FIGS. 3, 4, and 5, a die casting method is provided, which can be implemented by the die casting machine 10 as described above. The die casting method mainly includes the following steps.

In step S310, a mold (or die) 100 having a die cavity 110 is provided. The mold (or die) 100 may include a fixed mold (or die) and a movable mold (or die). The fixed mold (or die) and the movable mold (or die) together form the die cavity 110.

In step S320, a plurality of injection mechanism 200 are provided. Each injection mechanism 200 is provided with an injecting channel 241, and the plurality of injecting channels are in connection with different positions of the die cavity 110.

In step S330, molten liquid is injected into the die cavity through the plurality of injecting channels. For example, the injecting channels 241 of the plurality of injection mechanisms 200 inject the molten liquid into the die cavity 110 at different positions of the die cavity 110. Taking three coordinate axes of a space rectangular coordinate system as a reference, the injecting channel 241 can inject the molten liquid at different positions of the die cavity 110 in a first direction (X-axis direction), or at different positions of the die cavity 110 in a second direction (Y-axis direction) and/or at different positions of the die cavity 110 in a third direction (Z-axis direction). Therefore, the time required for the die cavity 110 and the void to be filled with the molten liquid can be reduced, ensuring that the die casting pieces are quickly and accurately formed and have sufficient structural strength.

In step S340, the molten liquid in the die cavity 110 is cooled. The molten liquid can be cooled naturally along with a furnace, or cooled by water cooling or oil cooling according to actual needs.

In some embodiments, the molten liquid is injected into the die cavity 110 through the plurality of injecting channels 241. For example, the injecting channels 241 of all the injection mechanisms 200 inject the molten liquid into the die cavity 110 simultaneously. In other embodiments, the molten liquid can also be injected into the die cavity 100 through the plurality of injecting channels 241 in a chronological order.

Technical features of the above embodiments can be arbitrarily combined. For simplifying the description, all possible combinations of technical features in the above embodiments are not described. However, as long as there is no contradiction in the combination of these technical features, they should be fallen within the scope of this description.

Only several implementations of the present disclosure are illustrated in the aforementioned embodiments, and the description thereof is relatively specific and detailed, but it should not be understood as a limitation on the scope of the present disclosure. It should be noted that for those of ordinary skill in the art, without departing from the concept of the present disclosure, several modifications and improvements can be made, which all fall within the protection scope of the present disclosure. Therefore, the protection scope of the present disclosure shall be subject to the appended claims.

What is claimed is:

1. A die casting machine, used in cooperation with a mold or die having a die cavity configured to receive molten liquid, the die casting machine comprising:

a plurality of injection mechanisms in connection with the mold or die, each injection mechanism being provided with an injecting channel, molten liquid being injected into the die cavity through the plurality of injecting channels, the plurality of injecting channels being in connection with different positions of the die cavity, wherein the die cavity is partially defined by a left inner wall of the mold or die, the plurality of injection mechanisms comprise a left injection mechanism whose injecting channel extends through the left inner wall, wherein the die cavity is further partially defined by a right inner wall of the mold or die, the left inner wall and the right inner wall are spaced apart in a first direction, the plurality of injection mechanisms comprise a right injection mechanism whose injecting channel extends through the right inner wall, wherein the die cavity is further partially defined by a front inner wall and a rear inner wall of the mold or die, the front inner wall and the rear inner wall are spaced apart in a second direction perpendicular to the first direction, the front, left, rear, and right inner walls are successively connected, the plurality of the injection mechanisms further comprise a front injection mechanism whose injecting channel extends through the front inner wall and a rear injection mechanism whose injecting channel extends through the rear inner wall, and wherein the die cavity is further partially defined by an upper inner wall and a lower inner wall of the mold or die, the upper inner wall and the lower inner wall are spaced apart in a third direction perpendicular to the first direction and the second direction, the upper inner wall is connected to upper ends of the front, left, rear, and right inner walls, the lower inner wall is connected to lower ends of the front, left, rear, and right inner walls, the plurality of the injection mechanisms further comprise an upper injection mechanism whose injecting channel extends through the upper inner wall and a lower injection mechanism whose injecting channel extends through the lower inner wall.

2. The die casting machine according to claim 1, wherein a central axis of the injecting channel of the left injection mechanism and a central axis of the injecting channel of the right injection mechanism are parallel with the first direction.

3. The die casting machine according to claim 1, wherein a central axis of the injecting channel of the left injection mechanism and a central axis of the injecting channel of the right injection mechanism form an angle with the first direction.

4. The die casting machine according to claim 1, wherein a central axis of the injecting channel of the front injection mechanism and a central axis of the injecting channel of the rear injection mechanism are parallel with or inclined with the second direction.

5. The die casting machine according to claim 1, wherein a central axis of the injecting channel of the upper injection mechanism and a central axis of the injecting channel of the lower injection mechanism are parallel with or inclined with the third direction.

6. The die casting machine according to claim 1, wherein the mold or die is provided with a plurality of casting channels in connection with the die cavity, the injection mechanism further comprises an injecting chamber inserted into the casting channel, the injecting channel is provided in the injecting chamber.

* * * * *